United States Patent [19]

Thomas

[11] Patent Number: 4,603,717

[45] Date of Patent: Aug. 5, 1986

[54] SLIDING DOVETAIL TEMPLATE

[76] Inventor: Donald E. Thomas, Rte. 2, Box 227, Mebane, N.C. 27302

[21] Appl. No.: 735,828

[22] Filed: May 16, 1985

[51] Int. Cl.[4] ..... B27C 5/10

[52] U.S. Cl. ..... 144/144.5 GT; 33/562; 83/821

[58] Field of Search ..... 144/27, 85, 87, 90, 144/91, 137, 144 R, 144.5, 144.5 GT; 83/821; 33/562, 563, 564, 565, 566; 269/41, 87.1

[56] References Cited

U.S. PATENT DOCUMENTS

| | | | |
|---|---|---|---|
| D. 116,007 | 8/1939 | Bakallie | 33/562 |
| 3,376,650 | 4/1968 | Cook | 33/562 |
| 3,878,875 | 4/1975 | McCord, Jr. | 144/144.5 |
| 4,479,523 | 10/1984 | Peterson et al. | 144/144.5 |

*Primary Examiner*—Lowell A. Larson
*Assistant Examiner*—Jorji M. Griffin
*Attorney, Agent, or Firm*—Paul Overhauser; Lynn E. Barber

[57] ABSTRACT

Disclosed is a template for forming tapered sliding dovetail joints. The template is particularly useful for making tapered sliding dovetail joints using powered hand tools, such as a router. The template has a longitudinally extending groove which is narrower at one end than at the other. To form a sliding dovetail groove, a workpiece is placed underneath the template, and a dovetail cutter is passed along the sides of the groove. The template also has two longitudinally extending grooves which are tapered towards each other. To cut a sliding dovetail tongue, the end of a workpiece is placed below the template so the edges of the workpiece are exposed through the grooves, but the middle of the workpiece is covered by the template. A dovetail cutter is passed along the sides of each groove, creating a dovetail tongue. The template may also be secured to a dovetailing jig, to provide secure alignment and holding of the workpieces against the template.

5 Claims, 4 Drawing Figures

SLIDING DOVETAIL TEMPLATE

FIELD OF THE INVENTION

This invention relates to a device for forming dovetail joints in wooden workpieces and more particularly, to a device for cutting tapered sliding dovetail tongue and groove joints.

BACKGROUND OF THE INVENTION

There are many advantages of using sliding dovetail joints, particularly in forming shelving. However, one problem is that it is difficult for a craftsman to cut accurately-fitting dovetail joints to join boards to carcass sides. Another problem is that it is difficult to slide the dovetail tongue into the groove without the joint being either too loose or too tight. This problem can be solved to some extent by mutually tapering the tongue and the groove. The advantage of a slight taper in the dovetail is that the tongue will slide freely into the dovetail groove until it nears the end of the groove, at which time the fit begins to tighten up. However, it is difficult to accurately taper such a joint by hand using conventional woodworking tools.

OBJECTS OF THE INVENTION

A primary object of the invention is to provide a novel device for forming sliding dovetail joints, particularly, joints which are tapered.

Another object of the invention is to provide a novel device for forming sliding dovetail joints wherein extreme accuracy and repeatability of cuts are achieved with resulting precision in the dovetail joints between the adjoining wooden workpieces.

Another object of the invention is to provide a novel device for forming sliding dovetail joints which can be used with conventional hand-held woodworking tools, including a hand-held power router.

Another object of the invention is to provide a novel sliding dovetail template which allows both tongues and grooves to be cut from the same template, thus eliminating the need for separate templates.

Another object of the invention is to provide a novel sliding dovetail template which can be used to cut sliding dovetail tongues and grooves on wooden workpieces of different thicknesses and sizes.

Additional objects and advantages of the invention will be obvious from the description or may be learned by practice of the invention. The objects and advantages of the invention may be realized and attained by means of the instrumentalities and combinations particularly pointed out in the appended claims.

SUMMARY OF THE INVENTION

The present invention is a template employing guide slots positioned in the template to allow the cutting of a dovetail tongue on one wooden workpiece and a dovetail groove on a second workpiece such that the dovetail tongue will slide freely into the dovetail groove and will fit snugly when in final position. In the preferred embodiment of the invention, the guide slots are tapered to allow tapered tongues and grooves to be cut.

DETAILED DESCRIPTION OF THE DRAWINGS

Figure 1:
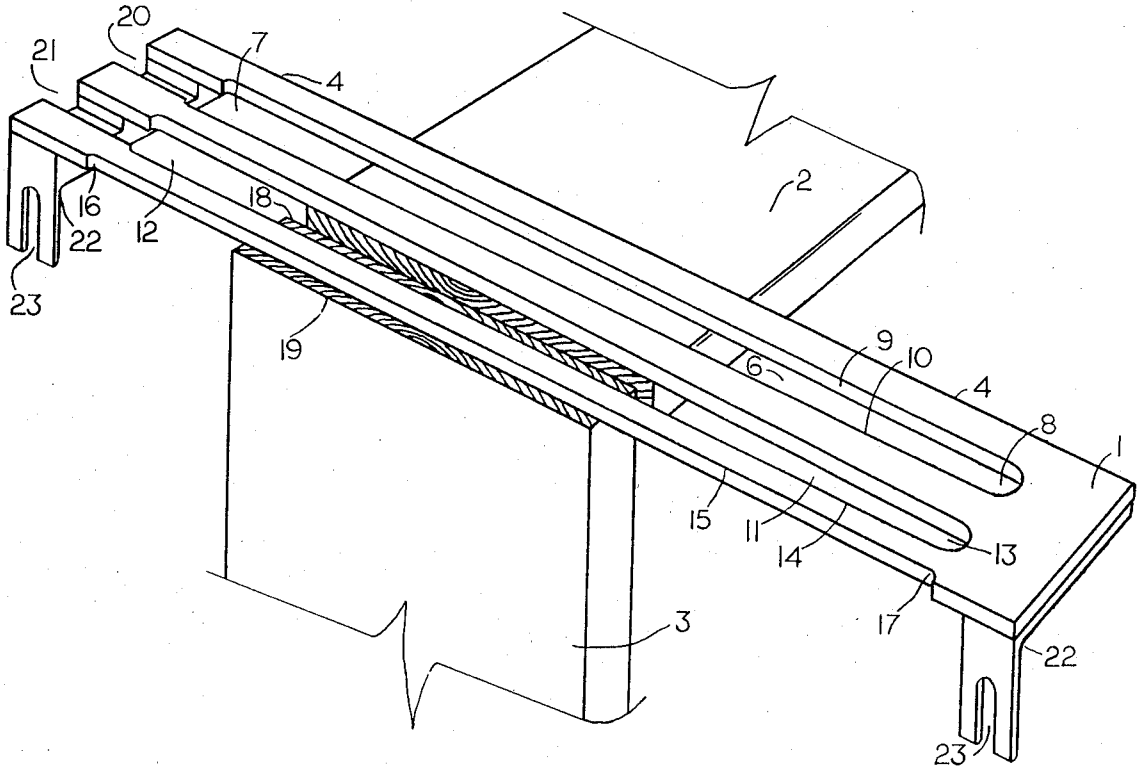
FIG. 1 is a perspective view showing the dovetail template constructed in accordance with the preferred embodiment of the present invention, including the positions for placing the wooden workpieces.

Referring to FIG. 1, the template comprises an elongated template 1, preferably formed of a rigid material, having a first edge 4. The elongated template 1 has a longitudinally extending female cut groove slot 6, with a first end 7, a second end 8, a first edge 9, and a second edge 10; a longitudinally extending male cut tongue slot 11 having a first end 12, a second end 13, and a guide edge 14; and a longitudinally extending male cut indentation 15 having a first end 16 and a second end 17.

The longitudinally extending female cut groove slot 6 is wider at its first end 7 than it is at its second end 8. Both first edge 9 and second edge 10 taper towards each other as they approach second end 8. Preferably, this taper for each edge should amount to about 0.024 inches per foot. These tapers have been exaggerated in the drawing in order to demonstrate this aspect. This taper provides a tapered groove to be cut which allows for a tight fit between the workpieces, while still providing easy insertion of the male workpiece into the female workpiece. The taper in the edges 9 and 10 may be eliminated, if it is desired to cut just sliding dovetail joints, as opposed to tapered sliding dovetail joints.

In order to cut a sliding dovetail female groove, a workpiece 2 is positioned below template 1 so that the width of the workpiece is between the ends 7 and 8 of the female groove guide slot 6. Preferably, the workpiece should be securely clamped to the template and the workpiece 2 should be perpendicular to first edge 4. A rotary dovetail cutter, preferably a high speed router with a dovetail cutter (see FIG. 4,) is placed in the female groove slot 6 adjacent to the workpiece 2. The cutter may be placed in female groove slot 6 via template insertion gap 20. The depth of the cutter must be deep enough to allow the cutter to cut into the wood when the cutter is moved towards it. The cutter is then moved along the first edge 9 of female groove guide slot 6 from one end of of the guide slot to the other, and then moved along the second edge 10 of guide slot 6. The sliding dovetail female groove is cut as the cutter passes through the workpiece. If the template is constructed of a material which is not entirely rigid, it is important to not place undue pressure against the edges of the groove slot, or else the template could bend and cause an inaccurate cut.

The guide edge 14 of longitudinally extending sliding dovetail male tongue guide slot 11 and longitudinally extending male tongue indentation 15 are both tapered so that they taper towards each other as they approach second end 13. Again, these tapers have been exaggerated in the drawing in order to fully demonstrate this aspect of the invention. Preferably, the tapers of guide edge 14 and indentation 15 should both taper at the same rate as the longitudinally extending female cut groove slot 6. However, the tapers in both guide edge 14 and indentation 15 can be eliminated if it is desired to cut only sliding dovetails as opposed to tapered sliding dovetails. Preferably, the traverse centerline (not shown) between guide edge 14 and indentation 15 should be parallel to first edge 4.

Ideally, the template should be constructed so that the width of the female groove guide slot 6 is proportional to the width of the portion of template 1 which lies between guide edge 14 of the male tongue guide slot 11 and indentation 15. Such a proportionality will ensure that the sizes of the female groove 27 and male tongue 26 cut in the workpieces will be of ideal dimensions, based upon a known width of the dovetail cutter blade 42, angle of the dovetail cutter, size of bearing 43 and depth of cut.

In order to cut a male sliding dovetail tongue, a workpiece 3 is positioned below the template 1 so that the top edges 18 and 19 are visible through the top of the template but the middle of the top end is covered by the portion of the template between male tongue guide slot 11 and male tongue guide indentation 15. Preferably, the workpiece should be positioned below the template the same distance from the first end 7 as the workpiece used to cut the female groove was placed from first end 7. This will ensure consistent widths of the tongue and groove. Also, the workpiece should be securely clamped to the template. A rotary dovetail cutter, preferably a high speed router with a dovetail bit (see FIG. 4,) is placed in the male tongue guide slot 11 adjacent to the wood. The cutter may be inserted into male tongue guide slot 11 via template insertion gap 21. The depth of the cutter must be deep enough to allow the cutter to cut into the workpiece when when the cutter is moved over it. Ideally, the cutter shoud be set to a depth equal to the depth used to cut the sliding dovetail female groove, in order to provide the best fit between the workpieces. The cutter is then moved along the guide edge 14 of male tongue guide slot 11 from the first end 12 of the guide slot to the second end 13, cutting one side of the dovetail tongue. The cutter is then placed along the male tongue guide indentation 15 and moved along the indentation from the first end 16 to the second end 17 to complete the cut.

Template 1 also has two angle brackets 22, each having guide slots 23, to allow template 1 to be attached to a work positioning structure when in use.

Figure 2:
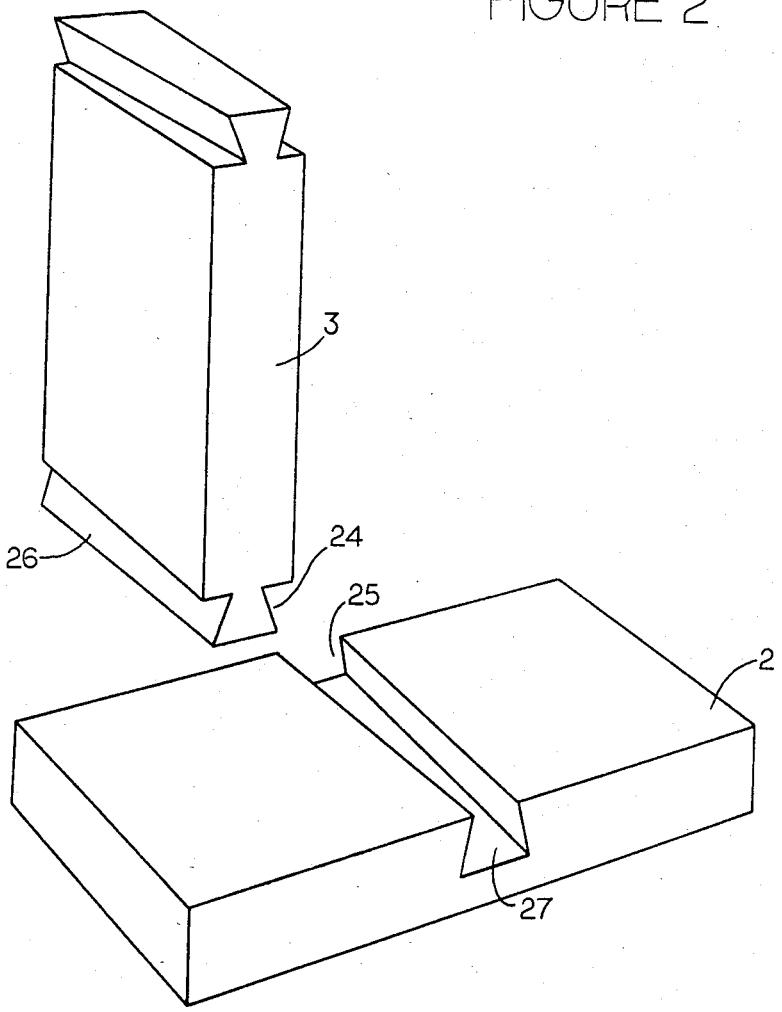
FIG. 2 is a perspective view of wooden workpieces illustrating the tapered tongue and groove formed in accordance with one embodiment of the present invention.

FIG. 2 discloses a tapered sliding dovetail male tongue cut in a first piece of wood 3 and a tapered sliding dovetail female groove cut in a second piece of wood 2 using the present invention. The taper of the cut in each piece has been exaggerated to demonstrate this aspect of the invention. The narrow end 24 of the tongue in the first piece of wood 3 is inserted into the wide end 25 of the groove in the second piece of wood 2. The tongue 26 of the first piece of wood 3 is then inserted fully into the groove 27 of the second piece of wood 2, providing a tight fit of the dovetail joint.

Figure 3:
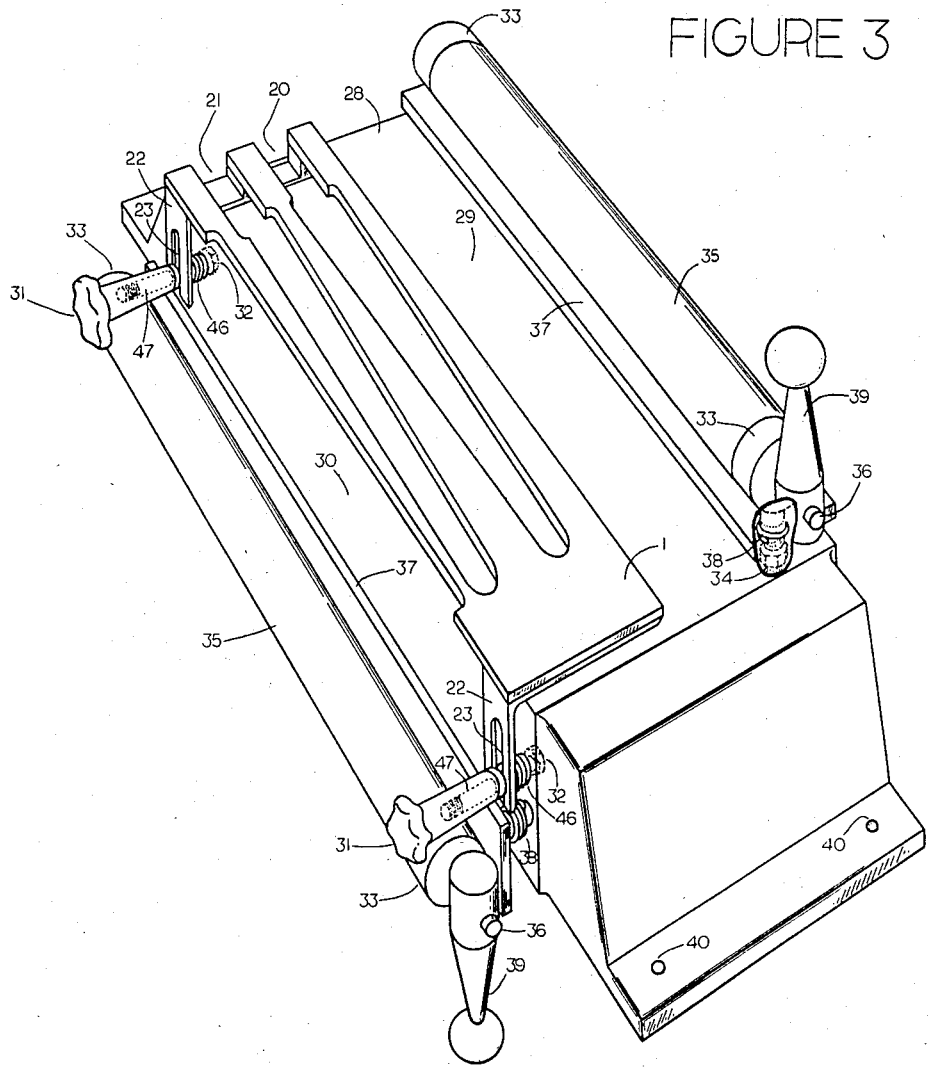
FIG. 3 is a perspective view of the template constructed in accordance with the preferred embodiment of the present invention mounted on a jig designed to hold the wooden workpieces in place while being cut.

FIG. 3 discloses a combination of the template and dovetailing jig which may be used to secure wooden workpieces 2 and 3 for cutting using the present invention. The jig comprises a frame 28 having a horizontal work receiving surface 29 and a vertical work receiving surface 30. The frame houses two studs 47 which can accommodate the locating slots 23 in the angle brackets 22 of the template 1. Hand screws 31 allow the template 1 to be tightly secured to the frame 28. The locating slots 23 in the angle brackets 22 allow the template 1 to be positioned at various heights with respect to horizontal work receiving surface 29. Spacing washers 46 provide a gross adjustment between angle brackets 22 and frame 28 to allow the template 1 to be positioned at various distances with respect to vertical work receiving surface 30. Fine adjustment of the distance between template 1 and vertical working surface 30 may be made by adjusting locknuts 32, which are screwed onto studs 47. Such adjustments are convenient to allow the template 1 to accommodate varying thicknesses of workpieces when used with the dovetailing jig.

Frame 28 also holds two cam clamp assemblies to hold the workpieces in place. Each clamp assembly is comprised of two eye bolts 33 which are secured to frame 28 by nuts 34. A cam clamp round 35 is positioned between the two eye bolts 33 and held in place by offset journals 36. A clamp flat 37 is placed between the clamp round 35 and the frame 28 to evenly distribute the pressure of the cam clamp against a workpiece. The clamp flat 37 is biased against the clamp round 35 via springs 38 which are placed around eye bolts 33. Each offset journal 36 is attached to a lever 39, which allows the clamp round 35 to be rotated to secure a workpiece between the cam clamp flat 37 and the horizontal or vertical work receiving surfaces, 29 and 30. Frame 28 also has holes 40, which allow frame 28 to be secured to a permanent location.

Figure 4:
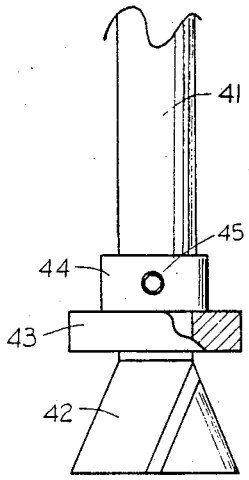
FIG. 4 is a perspective view of a dovetail cutter.

FIG. 4, discloses a dovetail cutter which may be used to cut tapered sliding dovetail tongues and grooves as described above. The dovetail cutter includes a shank 41 for securement in the collet of a power tool, such as a hand-held power router, a dovetail cutter blade 42, a bearing 43, and a shank collar 44. Bearing 43 is held in place by shank collar 44, which is secured to shank 41 by a set screw 45.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

I claim:

1. A template for making tapered sliding dovetails, comprising:

a plate constructed of a material sufficiently rigid to support a hand-held router, having:

an end;

a first longitudinally extending guide slot such that the opposite edges of said slot are straight and tapered toward each other, and such that said slot is capable of receiving a dovetail cutter;

a second longitudinally extending guide slot having a straight first guide edge, such that said slot is capable of receiving a dovetail cutter; and, a straight second guide edge on said plate;

such that said first and second guide edges are tapered toward each other; and such that the tapering of the opposite edges of said first longitudinally extending guide slot, of said first guide edge of said second longitudinally extending guide slot and of said second guide edge are all toward the same end of said plate;

and such that the centerline between the opposite edges of first guide slot and the centerline between the first and second guide edges are parallel.

2. The template as described in claim 1, further comprising a first gap in said plate disposed between said first longitudinally extending guide slot and an edge of said plate, sufficient in size to allow a dovetail cutter to be inserted into said first longitudinally extending guide slot through said first gap;

and a second gap in said plate disposed between said second longitudinally extending guide slot and an edge of said plate, sufficient in size to allow a dovetail cutter to be inserted into said second longitudinally extending slot through said second gap;

and rigid material disposed on the opposite sides of each of said gaps, said rigid material traversing said gaps and being sufficiently rigid to provide structural support for said template on the opposite sides of each gap.

3. The template as described in claim 1, further comprising means on said template for securing said template to a work positioning structure.

4. The template for making tapered sliding dovetails claimed in claim 1, wherein;

the rate of taper of the opposite edges of said first longitudinally extending guide slot is equal to the rate of taper of said first and second guide edges.

5. A template for making tapered sliding dovetails in combination with a work positioning structure, comprising:

a plate constructed of a material sufficiently rigid to support a hand-held router, having:

an end;

a first longitudinally extending guide slot such that the opposite edges of said slot are straight and tapered toward each other, and such that said slot is capable of receiving a dovetail cutter;

a second longitudinally extending guide slot having a straight first guide edge, such that said slot is capable of receiving a dovetail cutter; and, a straight second guide edge on said plate;

such that said first and second guide edges are tapered toward each other;

and such that the tapering of the opposite edges of said first longitudinally extending guide slot, of said first guide edge of said second longitudinally extending guide slot and of said second guide edge are all toward the same end of said plate;

and such that the centerline between the opposite edges of first guide slot and the centerline between the first and second guide edges are parallel;

and further comprising a first gap in said plate disposed between said first longitudinally extending guide slot and an edge of said plate, sufficient in size to allow a dovetail cutter to be inserted into said first longitudinally extending guide slot through said first gap;

means on said template for securing said template to a work positioning structure;

a work positioning structure having:

a frame having a horizontal work receiving surface and a vertical work receiving surface;

means on said frame for securing said template to said work positioning structure;

means on said frame for securing a first workpiece to said work positioning structure such that said first workpiece is positioned between said plate and said horizontal work receiving surface; and means on said frame for securing a second workpiece to said work positioning structure such that said second workpiece is positioned between said plate and said vertical work receiving surface.

* * * * *